US011246444B2

(12) United States Patent
Tan et al.

(10) Patent No.: US 11,246,444 B2
(45) Date of Patent: Feb. 15, 2022

(54) PUNCHING-FREE MOUNTING ASSEMBLY FOR INSTALLING A CURTAIN

(71) Applicant: NINGBO LIYANG NEW MATERIAL COMPANY LIMITED, Ningbo (CN)

(72) Inventors: Baoguo Tan, Ningbo (CN); Chun Jiang, Ningbo (CN)

( * ) Notice: Subject to any disclaimer, the term of this patent is extended or adjusted under 35 U.S.C. 154(b) by 0 days.

(21) Appl. No.: 16/932,256

(22) Filed: Jul. 17, 2020

(65) Prior Publication Data

US 2021/0137296 A1 May 13, 2021

(30) Foreign Application Priority Data

Nov. 7, 2019 (CN) ..... 201911081363.1

(51) Int. Cl.
*A47H 1/142* (2006.01)

(52) U.S. Cl.
CPC ..... *A47H 1/142* (2013.01)

(58) Field of Classification Search
CPC .. A47H 1/142; E06B 9/42; E06B 9/40; E06B 2009/407
See application file for complete search history.

(56) References Cited

U.S. PATENT DOCUMENTS 3,333,808 A * 8/1967 Du Boff ..... E04G 25/04 248/200.1
4,601,319 A * 7/1986 Georgopoulos ..... B60J 1/2088 160/178.1 R
4,848,432 A * 7/1989 Connolly ..... E06B 9/174 160/178.1 R
7,549,615 B2 * 6/2009 Shevick ..... E06B 9/266 160/168.1 R
7,621,313 B2 * 11/2009 Pham ..... E06B 9/40 160/23.1
10,538,962 B2 * 1/2020 Hall ..... E06B 9/323
2008/0230185 A1 * 9/2008 Kahn ..... E06B 9/44 160/23.1
2008/0245940 A1 * 10/2008 Brown ..... A47H 1/022 248/251
2009/0236050 A1 * 9/2009 Marzilli ..... E06B 9/40 160/241

(Continued)

FOREIGN PATENT DOCUMENTS

CN 209040732 U * 6/2019
DE 19640846 A1 * 4/1998 ..... E06B 9/42
DE 102014003497 A1 * 9/2015 ..... E06B 9/44

*Primary Examiner* — Kimberly T Wood
(74) *Attorney, Agent, or Firm* — W&KIP

(57) ABSTRACT

The present invention discloses a punching-free mounting assembly for installing a curtain, has a mounting seat; the mounting seat is provided with a top block slidingly connected with the mounting seat, and a self-locking unit used for pushing the top block; a part of the self-locking unit is exposed outside the mounting seat; the mounting seat is provided with a top block and a self-locking unit inside. In addition, a part of the self-locking unit is exposed outside the mounting seat, which is convenient for a user to adjust the self-locking unit, and since the self-locking unit is far away from the top block, interferences such as being too close to the wall body are avoided, making the installation more convenient and efficient.

8 Claims, 5 Drawing Sheets

(56) References Cited

U.S. PATENT DOCUMENTS

| | | | | |
|---|---|---|---|---|
| 2012/0152874 | A1* | 6/2012 | Didehvar | A47K 3/38<br>211/105.4 |
| 2015/0020984 | A1* | 1/2015 | Fennell | E06B 9/44<br>160/323.1 |
| 2019/0162023 | A1* | 5/2019 | Tan | A47H 1/12 |
| 2020/0305628 | A1* | 10/2020 | Tan | A47H 1/02 |

* cited by examiner

PUNCHING-FREE MOUNTING ASSEMBLY FOR INSTALLING A CURTAIN

CROSS-REFERENCE TO RELATED APPLICATIONS

This application claims priority to Chinese Patent Application No. 201911081363.1 with a filing date of Nov. 11, 2019. The content of the aforementioned applications, including any intervening amendments thereto, are incorporated herein by reference.

TECHNICAL FIELD

The present disclosure relates to the technical field of curtain installation, in particular to a punching-free mounting assembly for installing a curtain.

BACKGROUND

Curtains are widely used at homes, offices and the like, mainly for adjusting the indoor light, such as roller blinds, venetian blinds, honeycomb curtains, which are commonly used at present. Generally, during installation, the curtains need to be fixed to the window frame through installation parts and screws. Since the screw installation will generate screw holes in the window frame, and when the curtain is reinstalled or replaced, the holes need to be re-punched to ensure a firm installation, which inevitably leaves multiple screw holes in the wall body of the window frame. With the wall body damaged, and the appearance affected, and dust produced during the punching installation, the installation becomes time-consuming and laborious, and further dust cleaning may also be required.

SUMMARY

One objective of the present disclosure is to overcome the shortcomings of the prior arts by providing a punching-free mounting assembly for installing a curtain, which enables a quick installation of a curtain without punching and damaging the wall body, making the whole installation process convenient.

The technical solution of the present disclosure is as follows: a punching-free mounting assembly for installing a curtain, comprising a mounting seat; the mounting seat is provided with a top block slidingly connected with the mounting seat, and a self-locking unit used for pushing the top block; a part of the self-locking unit is exposed outside the mounting seat.

In a preferred embodiment, one end of the mounting seat is a closed end, the other end of the mounting seat is an open end; the self-locking unit comprises a worm gear, a worm, a lead screw and a lead screw nut, the worm gear is integrally formed with the lead screw, and the worm is in threaded fit with the worm gear; the lead screw nut is screwed on the lead screw; the closed end of the mounting seat is provided with a through hole for the lead screw to extend into, and the worm gear and the worm are exposed outside mounting seat.

In a preferred embodiment, the shape of the top block matches the shape of the inner cavity of the mounting seat, the top block is inwardly provided with a round cavity sleeved with a lead screw and a lead screw nut, and the lead screw nut is provided with a square end surface used for pushing the top block, the shape of the square end surface is matched with the shape of the inner cavity of the mounting seat.

In a preferred embodiment, the mounting seat is further provided with an elastic piece; one end of the elastic piece is sleeved with the lead screw nut and abuts against the square end surface of the lead screw nut, and the other end of the elastic piece inserts into the round cavity and abuts against the inner end surface of the top block.

In a preferred embodiment, the outer end surface of the top block is connected with a top cover.

In a preferred embodiment, the two outer side walls of the top block are symmetrically provided with guide blocks, and guide grooves matched the guide blocks are formed in the two inner side walls of the mounting seat; the ends of the guide grooves are provided with anti-falling blocks to prevent the guide blocks from slipping off, and the anti-falling blocks level with the open end of the mounting seat.

In a preferred embodiment, the closed end of the mounting seat is provided with a connecting cover, the connecting cover is provided with a first arc-shaped groove, and the mounting seat is provided with a second arc-shaped groove opposite to the first arc-shaped groove; the first arc-shaped groove and the second arc-shaped groove are spliced into an accommodating cavity for containing the worm.

In a preferred embodiment, the connecting cover is internally provided with a concave cavity for avoiding the worm gear, and the concave cavity is communicated with the accommodating cavity.

In a preferred embodiment, the two ends of the accommodating cavity are communicated with the outside; the accommodating cavity is symmetrically provided with first annular step surfaces inside, and the worm is provided with second annular step surfaces matched with the first annular step surfaces.

In a preferred embodiment, one end of the connecting cover, the end of which away from the mounting seat, extends to form a connecting part for connecting the mounting rod of the curtain.

When compared with the prior art, the present invention has the advantages that: the mounting seat is provided with a top block and a self-locking unit inside, and the top block is pushed outwards to firmly locked on the wall body and locked by the mechanical force of the self-locking unit, which also prevents the top block from sliding reversely, so that the curtain is installed on the window frame to achieve a punching-free installation without damaging the wall body. In addition, a part of the self-locking unit is exposed outside the mounting seat, which is convenient for a user to adjust the self-locking unit, and since the self-locking unit is far away from the top block, interferences such as being too close to the wall body are avoided, making the installation more convenient and efficient.

Embodiments

Figure 1:
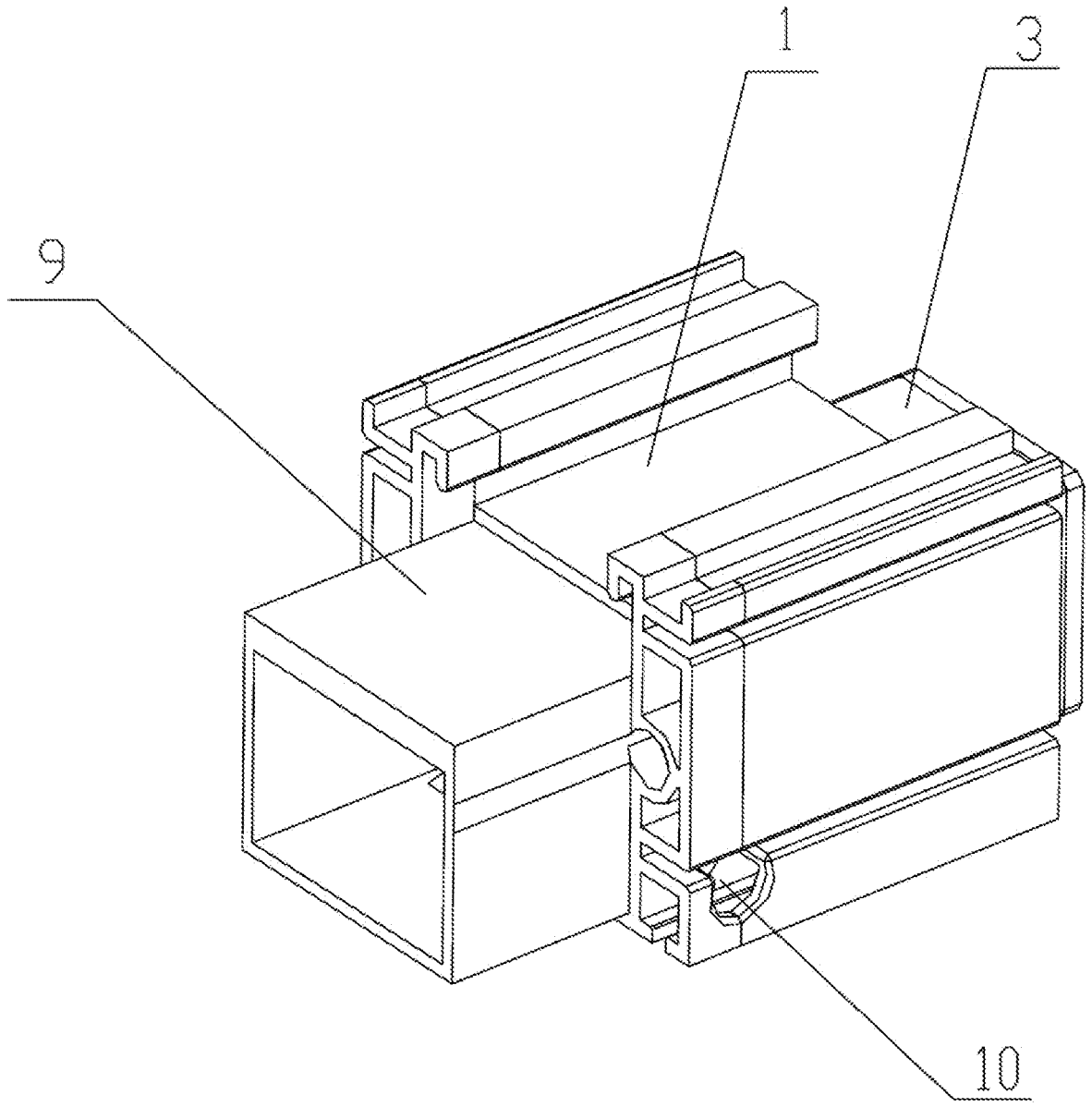
FIG. 1 is a schematic structural view of the present invention.
Figure 2:
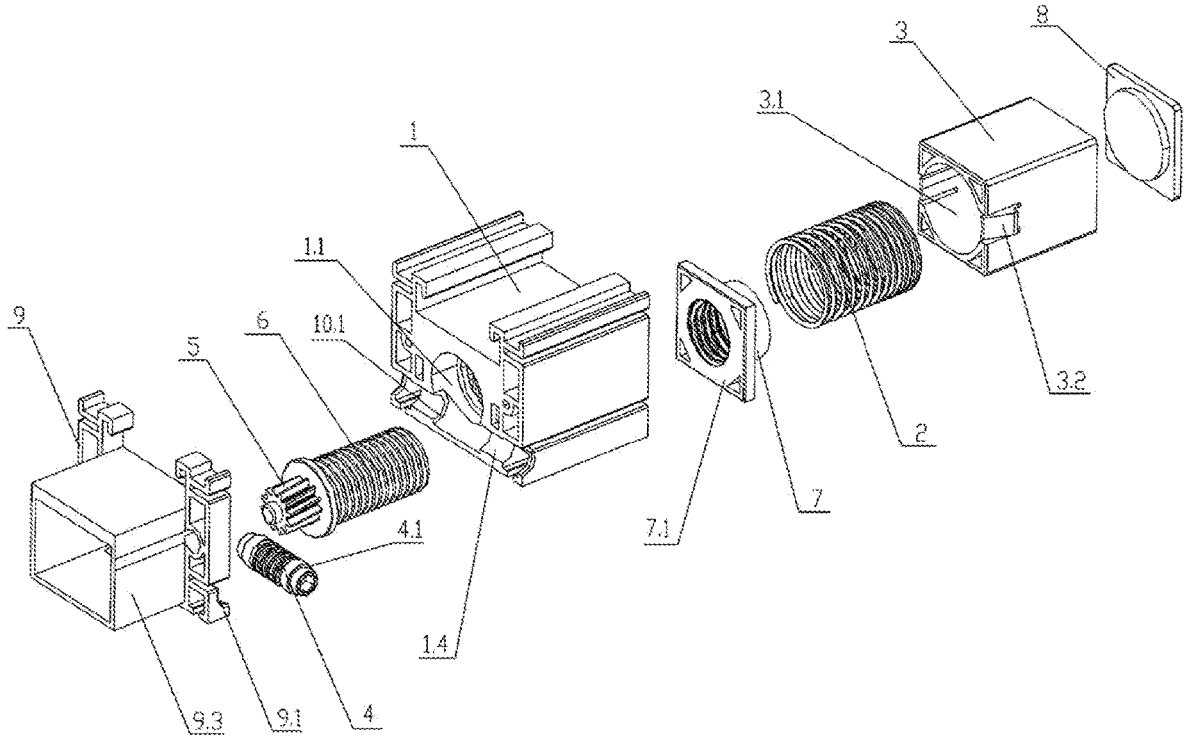
FIG. 2 is an exploded view of the present invention.
Figure 3:
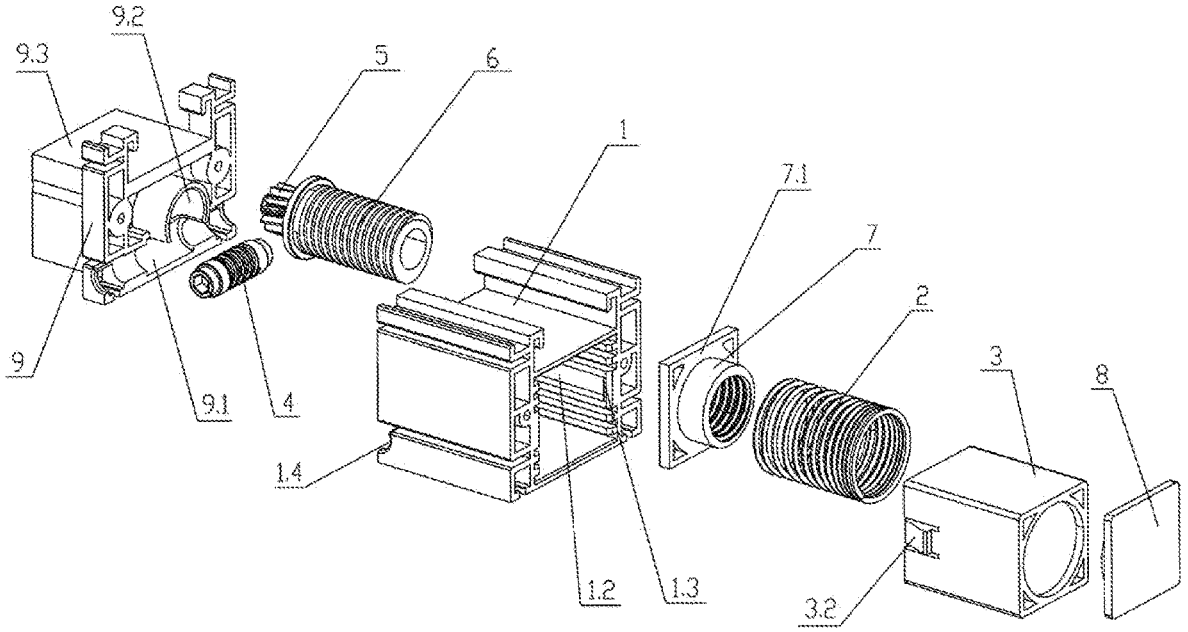
FIG. 3 is an exploded view of another perspective of the present invention.
Figure 4:
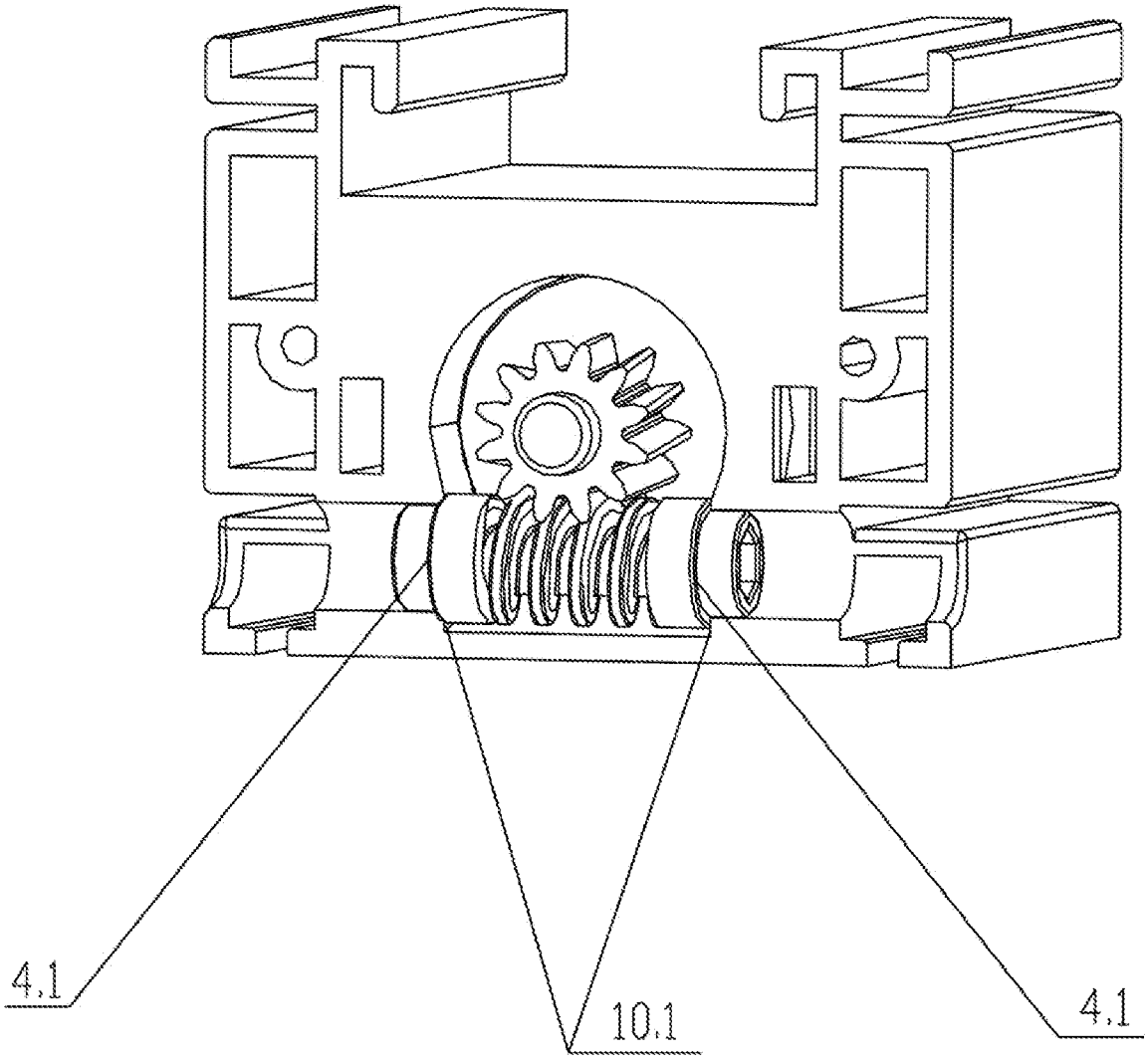
FIG. 4 is a schematic structural view of the present invention without the connection cover.

Various aspects of the illustrative embodiments herein will be described below using terms commonly employed by those skilled in the art to convey the substance of their work to others stilled in the art. However, it will be apparent to those skilled in the art that alternate embodiments may be practiced with only some of the described aspects. For purposes of explanation, specific numbers, material and configuration are set forth in order to prove a thorough understanding of the illustrative embodiments. However, it will be apparent to one skilled in the art that alternate embodiments may be practiced without the specific details. In other instances, well-known features are omitted or simplified in order not to obscure the illustrative embodiments.

As shown in FIGS. 1-4, a punching-free mounting assembly for installing a curtain, comprising a mounting seat 1; the mounting seat 1 is provided with a top block 3 slidingly connected with the mounting seat 1, and a self-locking unit used for pushing the top block 3; a part of the self-locking unit is exposed outside the mounting seat 1.

One end of the mounting seat 1 is a closed end, the other end of the mounting seat 1 is an open end; the self-locking unit comprises a worm gear 5, a worm 4, a lead screw 6 and a lead screw nut 7, the worm gear 5 is integrally formed with the lead screw 6, and the worm 4 is in threaded fit with the worm gear 5; the lead screw nut 7 is screwed on the lead screw 6; the closed end of the mounting seat 1 is provided with a through hole 1.1 for the lead screw 6 to extend into, and the worm gear 5 and the worm 4 are exposed outside mounting seat 1; the shape of the top block 3 matches the shape of the inner cavity of the mounting seat 1, the top block 3 is inwardly provided with a round cavity 3.1 sleeved with the lead screw 6 and the lead screw nut 7, and the lead screw nut 7 is provided with a square end surface 7.1 used for pushing the top block 3, the shape of the square end surface 7.1 is matched with the shape of the inner cavity of the mounting seat 1; the worm 4 is screwed to rotate by an external driving component, and the worm 4 drives the worm gear 5 to rotate; the worm gear 5 drives the lead screw 6 to rotate synchronously, and the lead screw 6 drives the lead screw nut 7 to move along the length direction of the lead screw 6; the square end surface 7.1 of the lead screw nut 7 squeezes and pushes the top block 3 until the top block 3 is locked, and the top block 3 is tightened to the wall surface; with the cooperation of the worm gear 5, the worm 4, and the lead screw 6, the axial rotation is converted into the radial rotation, and the mechanical force of the self-locking unit locks the top block 3, which is convenient for installation and adjustment; further, the mounting seat 1 is provided with an elastic piece 2; one end of the elastic piece 2 is sleeved with the lead screw nut 7 and abuts against the square end surface 7.1 of the lead screw nut 7, and the other end of the elastic piece 2 inserts into the round cavity 3.1 and abuts against the inner end surface of the top block 3; due to the setting of the elastic piece 2, during the pre-installation, the elastic piece 2 will exert an elastic force onto the top block 3, so that the top block 3 is pre-positioned on the wall surface, and when the external drive component screws worm 4 to rotate; the worm 4 drives the worm gear 5 to rotate; the worm gear 5 drives the lead screw 6 to rotate synchronously, and the lead screw 6 drives the lead screw nut 7 to move along the length direction of the lead screw 6; the square end surface 7.1 of the lead screw nut 7 pushes the elastic piece 2, and the elastic piece 2 pushes the top block 3, as the elastic piece 2 is squeezed, the elastic force received by the top block 3 becomes larger and larger until the elastic piece 2 is completely pushed into the round cavity 3.1, the square end surface 7.1 of the lead screw nut 7 abuts against the top block 3, and the top block 3 is completely locked; the elastic piece 2 applies an elastic force to the top block 3 during the pre-installation process so that the top block 3 can be placed on the wall to achieve a predetermined position, making the installation and positioning more convenient and accurate, preferably, the elastic piece 2 is a spring or a repulsive magnet group; the two outer side walls of the top block 3 are symmetrically provided with guide blocks 3.2, and guide grooves 1.2 matched the guide blocks 3.2 are formed in the two inner side walls of the mounting seat 1; the ends of the guide grooves 1.2 are provided with anti-falling blocks 1.3 to prevent the guide blocks 3.2 from slipping off, and the anti-falling blocks 1.3 level with the open end of the mounting seat 1; the guide block 3.2 is provided with an inclined guide surface, during the process of assembling the top block 3 into the mounting seat 1, the top block 3 can be smoothly pushed into the mounting seat 1 along the inclined guide surface, and when the top block 3 slides in the reverse direction under the elastic force of the elastic piece 2, the anti-falling block 1.3 blocks the guide block 3.2 from sliding out of the guide groove 1.2 to prevent the top block 3 from detaching from the mounting seat 1; one end of the top block 3 extends out of the mounting seat 1 for abutting the wall to achieve installation, and the other end of the top block 3 always slides within the range of the inner cavity of the mounting seat 1; the sliding distance of the guide block 3.2 in the guide groove 1.2 is the telescopic displacement of the top block 3.

Preferably, the outer end surface of the top block 3 is connected with a top cover 8, which increases the friction between the top block 3 and the wall to avoid slippery situation, having better contact with the wall and making it more stable to be locked on the wall, as well as an improvement of the appearance.

The closed end of the mounting seat 1 is provided with a connecting cover 9, the connecting cover 9 is provided with a first arc-shaped groove 9.1, and the mounting seat 1 is provided with a second arc-shaped groove 1.4 opposite to the first arc-shaped groove 9.1; the first arc-shaped groove 9.1 and the second arc-shaped 1.4 groove are spliced into an accommodating cavity 10 for containing the worm 4; the accommodating cavity 10 is vertically distributed with the inner cavity of the mounting seat 1, and the first arc-shaped groove 9.1 and the second arc-shaped groove 1.4 are spliced to accommodate the worm 4, which facilitates the disassembly and replacement of the parts;

the connecting cover 9 is internally provided with a concave cavity 9.2 for avoiding the worm gear 5, and the concave cavity 9.2 is communicated with the accommodating cavity 10; the two ends of the accommodating cavity 10 are communicated with the outside, so that the external driving component can easily insert into the accommodating cavity 10 to screw the worm 4 to achieve the purpose of self-locking; the accommodating cavity 10 is symmetrically provided with first annular step surfaces 10.1 inside, and the worm 4 is provided with second annular step surfaces 4.1 matched with the first annular step surfaces 10.1; the first annular step surface 10.1 and the second annular step surface 4.1 cooperate with each other to prevent the worm 4 from falling out of the accommodating cavity 10 during rotation and also to avoid displacement of the worm 4 along its length direction, which in turns protects the worm 4 and the worm gear 5 and prevents the worm 4 and the worm gear 5 from being damaged.

A connecting part 9.3 for connecting the mounting rod of a curtain is extended on the end of the connecting cover 9 away from the mounting seat 1 to facilitate assembly with the mounting rod of a curtain.

Figure 5:
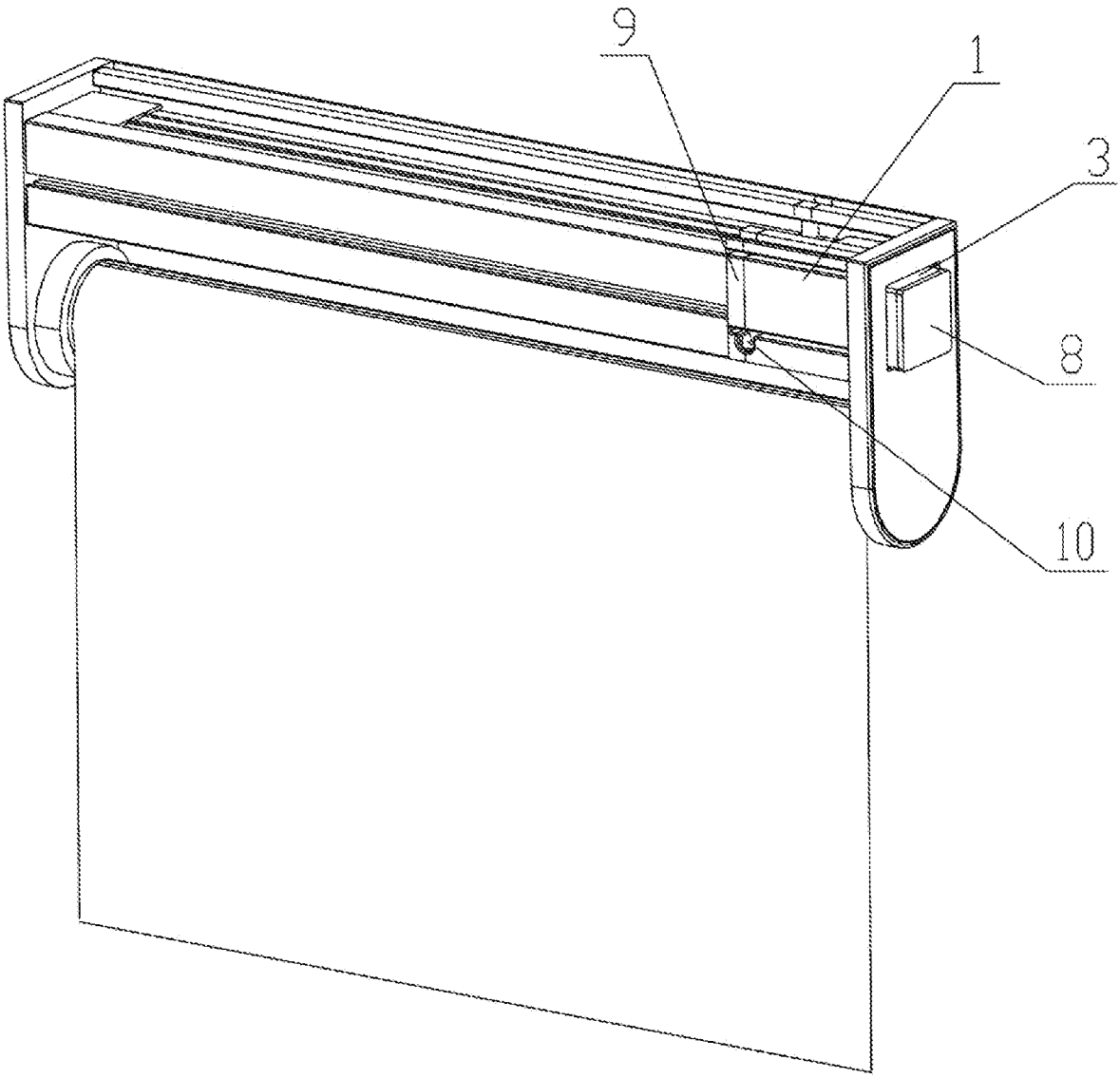
FIG. 5 is a reference diagram of the use state of the present invention. As shown in the figures, 1 mounting seat; 1.1 through hole; 1.2 guide groove; 1.3 anti-falling block; 1.4 the second arc-shaped groove; 2 elastic piece; 3 top block; 3.1 round cavity; 3.2 guide block; 4 worm; 4.1 the second annular step surface; 5 worm gear; 6 lead screw; 7 lead screw nut; 7.1 square end surface; 8 top cover; 9 connecting cover; 9.1 the first arc-shaped groove; 9.2 concave cavity; 9.3 connecting part; 10 accommodating cavity; 10.1 the first annular step surface.

When in use, as shown in FIG. 5, simply by inserting the punching-free mounting assembly directly with the mounting rod of a curtain, then connecting the assembly with the curtain body through the connecting parts at both ends, and pre-positioning the curtain on the window frame with the top block 3 pressed against the wall surface under the action of the elastic force of the elastic piece 2, through the insertion of the external driving component into the accommodating cavity 10 to screw the worm 4 to rotate, the worm 4 drives the worm gear 5 to rotate, and the worm gear 5 drives the lead screw 6 to rotate synchronously; since the square end surface 7.1 of the lead screw nut 7 on the lead screw 6 matches with the shape of the inner cavity of the mounting seat 1, the lead screw nut 7 is limited, and the lead screw nut 7 cannot rotate synchronously with the lead screw 6, so the lead screw nut 7 is pushed along the length direction of the lead screw 6 by the rotation of the lead screw 6, the square end surface 7.1 of the lead screw nut 7 pushes the elastic piece 2 into the direction of the top block 3, until the elastic piece 2 is completely pushed into the round cavity 3.1, the square end surface 7.1 of the lead screw nut 7 is pressed against the top block 3, thereby locking the top block 3, avoiding the top block 3 from sliding in the reverse direction, and supporting the curtain on the window frame to realize a punching-free installation without damaging the wall. In case the curtain needs to be replaced or disassembled, inserting the external driving component into the accommodating cavity 10 to reversely screw the worm 4 to rotate; the worm 4 drives the worm gear 5 to rotate, the worm gear 5 drives the lead screw 6 to rotate synchronously, and the lead screw nut 7 on the screw 6 moves in the direction away from the top block 3; the elastic piece 2 is released, and the elastic force is reduced; the top block 3 is unlocked, and the top block 3 can be pressed to move into the mounting seat 1, so that the top block 3 is separated from the wall surface, and the curtain can be easily removed. In addition, since the worm 4 is set far away from the top block 3, when the driving part is used to screw the worm 4, the worm 4 is arranged away from the wall, the external driving component will not hit the wall when inserting, and it is more convenient for the external driving component to screw and rotate the worm 4, and avoiding potential awkward operations because of being too close to the wall.

Although certain embodiments have been illustrated and described herein for purposes of description, a wide variety of alternate and/or equivalent embodiments or implementations calculated to achieve the same purposes may be substitute for the embodiments shown and described without departing from the scope of the present disclosure. It should be noted that the above embodiments are only for illustrating the technical solutions of the present invention. This application is intended to cover any adaptations or variations of the embodiments discussed herein. Therefore, it is manifestly intended that embodiments described herein be limited only by the claim and the equivalents thereof, and these modifications or replacements do not deviate from the spirit and scope of the technical solutions of the embodiments of the present invention.

We claim:

1. A punching-free mounting assembly for installing a curtain, comprises: a mounting seat (1); wherein the mounting seat (1) is provided with a top block (3) slidingly connected with the mounting seat (1), and a self-locking unit used for pushing the top block (3); a part of the self-locking unit is exposed outside the mounting seat (1);

wherein one end of the mounting seat (1) is a closed end, the other end of the mounting seat (1) is an open end; the self-locking unit comprises a worm gear (5), a worm (4), a lead screw (6) and a lead screw nut (7), the worm gear (5) is integrally formed with the lead screw (6), and the worm (4) is in threaded fit with the worm gear (5); the lead screw nut (7) is screwed on the lead screw (6); the closed end of the mounting seat (1) is provided with a through hole (1.1) for the lead screw (6) to extend into, and the worm gear (5) and the worm (4) are exposed outside mounting seat (1).

2. The punching-free mounting assembly for installing a curtain of claim 1, wherein a shape of the top block (3) matches a shape of an inner cavity of the mounting seat (1), the top block (3) is inwardly provided with a round cavity (3.1) sleeved with the lead screw (6) and the lead screw nut (7), and the lead screw nut (7) is provided with a square end surface (7.1) used for pushing the top block (3), a shape of the square end surface (7.1) is matched with the shape of the inner cavity of the mounting seat (1).

3. The punching-free mounting assembly for installing a curtain of claim 2, wherein the mounting seat (1) is provided with an elastic piece (2); end of the elastic piece (2) is sleeved with the lead screw nut (7) and abuts against the square end surface (7.1) of the lead screw nut (7), and second end of the elastic piece (2) inserts into the round cavity (3.1) and abuts against inner end surface of the top block (3).

4. The punching-free mounting assembly for installing a curtain of claim 1, wherein outer end surface of the top block (3) is connected with a top cover (8).

5. The punching-free mounting assembly for installing a curtain of claim 1, wherein the closed end of the mounting seat (1) is provided with a connecting cover (9), the connecting cover (9) is provided with a first arc-shaped groove (9.1), and the mounting seat (1) is provided with a second arc-shaped groove (1.4) opposite to the first arc-shaped groove (9.1); the first arc-shaped groove (9.1) and the second arc-shaped (1.4) groove are spliced into an accommodating cavity (10) for containing the worm (4).

6. The punching-free mounting assembly for installing a curtain of claim 5, wherein the connecting cover (9) is internally provided with a concave cavity (9.2) for avoiding the worm gear (5), and the concave cavity (9.2) is communicated with the accommodating cavity (10).

7. The punching-free mounting assembly for installing a curtain of claim 5, wherein the two ends of the accommodating cavity (10) are communicated with the outside; the accommodating cavity (10) is symmetrically provided with first annular step surfaces (10.1) inside, and the worm (4) is provided with second annular step surfaces (4.1) matched with the first annular step surfaces (10.1).

8. The punching-free mounting assembly for installing a curtain of claim 5, wherein one end of the connecting cover (9), the one end of which away from the mounting seat (1), extends to form a connecting part (9.3) for connecting the mounting rod of a curtain.

* * * * *